United States Patent [19]

Goldstein

[11] 4,030,427

[45] June 21, 1977

[54] ARMOR PLATE

[75] Inventor: David Goldstein, Adelphi, Md.

[73] Assignee: The United States of America as represented by the Secretary of the Navy, Washington, D.C.

[22] Filed: Oct. 30, 1974

[21] Appl. No.: 519,464

[52] U.S. Cl. ..... 109/82; 89/36 A; 428/911; 428/49; 428/553; 428/615; 428/660

[51] Int. Cl.[2] ..... F41H 5/04

[58] Field of Search ..... 75/204; 89/36 A; 109/49.5, 80, 82, 83, 84; 428/47, 48, 49, 911; 29/191.2, 182.3, 182.7

[56] References Cited

UNITED STATES PATENTS

| | | | |
|---|---|---|---|
| 3,348,967 | 10/1967 | Hucke | 29/191.2 |
| 3,431,818 | 4/1965 | King | 89/36 A |
| 3,723,077 | 3/1973 | Krefeld | 109/82 |
| 3,756,787 | 9/1973 | Lange et al. | 75/204 |

*Primary Examiner*—Stephen C. Bentley
*Attorney, Agent, or Firm*—R. S. Sciascia; A. L. Branning; R. D. Johnson

[57] ABSTRACT

Armor plate formed of an array of tiles composed of titanium carbide particles dispersed in a matrix of tough, crack resistant titanium-nickel binary alloy. The tiles are mounted on a support layer which is an alloy of either aluminum or titanium or is a fragment resistant plastic which may be reinforced or non-reinforced.

3 Claims, 1 Drawing Figure

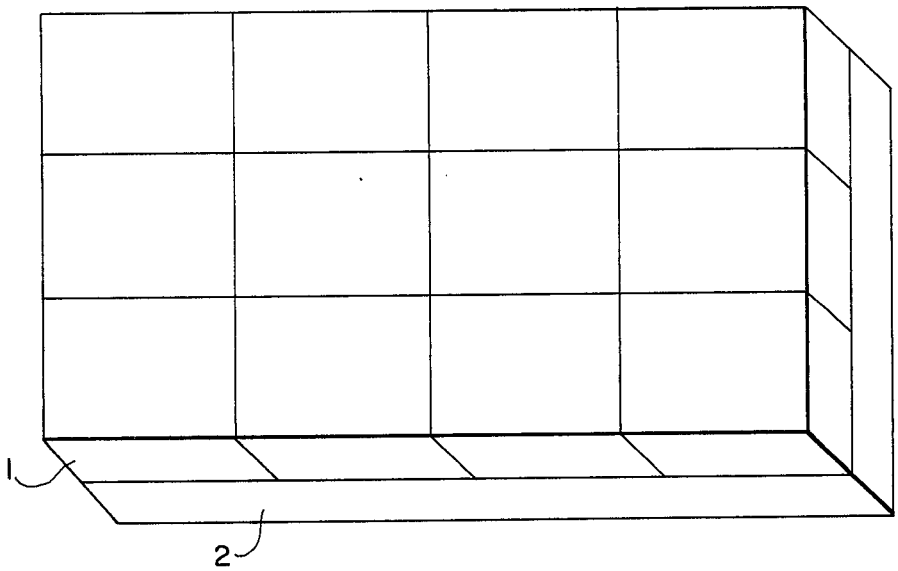
1
2

ARMOR PLATE

BACKGROUND OF THE INVENTION

This invention relates generally to armor plate and more particularly to light-weight multiple-impact defeating armor plate.

Broadly speaking, there are two main classes of light-weight armor plates: ceramic and metallic. The ceramic armor plates are the more efficient class from the standpoint of defeating armor piercing projectiles at the lowest weight per square foot of surface area (areal density). The ceramic armor sections are generally mounted on a tough support layer such as glass reinforced plastics. Boron carbide, silicon carbide and alumina are ceramics which are commonly used in armor plating.

Ceramic plates have the serious drawback of being unable to sustain and defeat multiple hits by armor piercing projectiles. Because relatively large sections of ceramic material must be used to stop these projectiles and because these sections shatter completely when hit by a projectile, the ceramic armor can not defeat a second projectile impacting close to the preceding impact. Moreover, sympathic shattering of adjacent ceramic sections usually occurs, still further increasing the danger of penetration by multiple rounds. Furthermore, ceramic armors are fragile and susceptible to catastrophic damage through normal handling.

In addition, ceramic armors are difficult and costly to manufacture, due to the very high manufacturing temperatures. Their processing may also be time consuming due to very slow cooling which is necessary to avoid cracking of the ceramic armor as its atomic structure transforms at the ceramic's inversion temperatures.

The other class of light-weight armor plate is metallic. Although this class possesses excellent ability to defeat multiple, closely spaced impacts of armor piercing projectiles, it is far heavier than desired, difficult to fabricate into intricate contours and difficult to repair in the field. Furthermore, its weight precludes its extensive use in such light-weight mobile weapons systems as helicopters and small water craft. In this regard, it should be noted that metallic armor of the same weight as ceramic armor is incapable of defeating armor piercing rounds.

An improved armor plate was disclosed in patent application Ser. No. 78,337 filed on Sept. 2, 1970, now abandoned, by David Goldstein and William J. Buehler. That armor plate was formed of an array of tiles composed of particles of a hard material which is a carbide, boride, nitride, silicide or mixture thereof dispersed in a matrix of tough, crack resistant iron based alloy, the tiles being attached to a support layer of tough, fragment resistant material. That armor was light weight, easy to manufacture and repair, and capable of stopping multiple, closely spaced impacts of armor piercing projectiles. However, it is desirable to find armor plating which has still better stopping capability while retaining the advantages of light weight and ease of manufacture and repair.

SUMMARY OF THE INVENTION

Accordingly, one object of this invention is to provide a new and improved light-weight armor plate.

Another object of the present invention is to provide light-weight armor plate having a multi-hit capacity.

Another object of this instant invention is to provide light-weight armor plate which is easy to fabricate.

Still another object of this invention is to provide light-weight armor which is easy to repair in the field.

A still further object of this invention is to provide a light-weight armor that has a relatively low areal density compared to armor which has comparable capacity of defeating multiple closely spaced impacting armor piercing projectiles.

These and other objects of this invention are accomplished by providing armor comprising tiles composed of titanium carbide dispersed in a matrix of tough crack resistant titanium-nickel alloy, the titanium carbide particles constituting from 30 to 60 weight percent of the tile and the matrix of titanium-nickel alloy the remainder, the composition of the matrix being from about 44 to about 46 titanium and from about 54 to about 56 nickel by weight percent, the hardness of the entire tiles being at least 82 Rockwell A. The tiles are attached to a tough metal or plastic support plate.

BRIEF DESCRIPTION OF THE DRAWINGS

The solitary FIGURE is a perspective view of the armor plate composite.

DESCRIPTION OF THE PREFERRED EMBODIMENT

The cermet tiles 1 of the FIGURE which form the outer portion of the armor, plate; i.e., the layer which is first impacted by an impinging projectile, is a composite containing from 30 to 60 percent by weight of hard finely dispersed titanium carbide particles in a matrix of a tough, crack resistant titanium-nickel alloy.

More specifically the tiles are composed of from 30 to 60 percent by weight titanium carbide with the titanium-nickel alloy matrix constituting the remainder of the tile.

The most preferred composition for the matrix alloy is TiNi, that is equal atomic fractions of Ti and Ni. If an excess of Ti over Ni is used, $Ti_2Ni$ is formed which is brittle and, therefore, undesirable. Similarly if an excess of Ni over Ti is used, $TNi_2$ is formed which is also brittle and, therefore, also undesirable. Thus, the composition of the titanium-nickel alloy used is from about 44 to about 46 weight percent titanium and from about 54 to about 56 weight percent nickel. The most preferred alloy would be composed of 50 atomic percent (44.930 wt. percent) titanium and 50 atomic percent (55.070 wt. percent) nickel.

A method which can be used to manufacture the tiles is disclosed in U.S. Pat. No. 3,235,346 issued on Feb. 15, 1966 to E. E. Hucke and entitled "Composite Bodies Comprising A Continuous Framework and An Impregnated Metallic Material and Methods Of Their Production." In this method a molten titanium nickel binary alloy is infiltrated into a porous carbon or graphite. The structure is then cooled to solidify the titanium-nickel alloy. Next, as disclosed in the Huckle patent, the structure is heated to provide the solid state conversion of carbon into titanium carbide. The result in a suspension of finely dispersed titanium carbide particles in a titanium-nickel matrix. Note that initially the alloy is rich in titanium; however, as titanium reacts with carbon to form titanium carbide, the weight percent of titanium in the titanium-nickel matrix alloy decreases.

The support layer 2 of the FIGURE must be formed of a primarily tough material, i.e., it can readily absorb energy, such as metal or plastic. The metals which can be used as support material include the high toughness, high strength to weight ratio metal alloys of aluminum or titanium. It will be recognized by those skilled in the art that generally as the yield strength increases its toughness decreases so that some type of balance between these two desirable properties is necessary.

In armor of the present type high yield strength is desirable in the support material to prevent its bowing after a high velocity projectile has struck the armor but the support material must also be tough to be able to absorb the impact energy of the projectile with little damage. A typical aluminum alloy comprises 0.1–0.4 weight percent Mn, 2.3–3.3 weight percent Mg, 0.15–0.25 weight percent Cr, 3.5–4.5 weight percent Zn with the remainder consisting essentially of aluminum. Another alloy comprises 4.5 weight percent Mg, 0.6 weight percent Mn, 0.8 weight percent Zn, 0.08 weight percent Cu, 0.35 weight percent Si, 0.35 weight percent Fe, 0.2 weight percent Cr, 0.1 weight percent Ti with the remainder consisting essentially of aluminum. A good guide to the aluminum alloys which are good support materials are those alloys with a Brinell hardness of 80–130. A typical titanium alloy that can be used as the support material is Ti-6Al-4V (ELI) which comprises 6 weight percent Al, 4 weight percent V, 0.03 weight percent C, 0.1 weight percent $O_2$, 0.015 weight percent $N_2$, 0.012 weight percent $H_2$, 0.2 weight percent Fe with the remainder consisting essentially of titanium. A good guide to the titanium alloys which are good support materials are those alloys with a Rockwell-C hardness of between 5 and 40.

The fragment resistant plastic support layer may be, for example, a polycarbonate, polyester, phenolic, polyolefin or epoxy. Additionally, it may be either reinforced or non-reinforced. The preferred reinforcing materials are filaments made of glass (usually S or E glass). The filamentary support materials may also be either wover or non-woven. These are common materials which have been used in armor of the prior art and have also been used to make boats, auto bodies, etc. The precise composition of the material is not critical since it is used as a support for the outer layer of armor. Furthermore, as one or ordinary skill in the art will recognize, a spall sheet may be placed over the outer layer of armor to prevent front-spall caused by an impacting projectile.

Mechanical methods of fastening armor tiles to tough backing or support layers are well known to those skilled in the art. These methods include cements, retainer pins, and woven fabric pockets. As in the case for ceramic armors, fabric pockets or plastic impregnated woven rovings will serve to retain tiles in position as well as retard spalling off of fragmentation from the front face of the armor. In summary, conventional armor tile fastening means will work in the present invention.

The general nature of the invention having been set forth, the following examples are presented as specific illustrations thereof. It will be understood that the invention is not limited to these specific examples but is susceptible to various modifications that will be recognized by one of ordinary skill in the art.

EXAMPLE I

Disk shaped tiles 1.6 inches in diameter and 0.314 inches thick were mounted on glass woven roving reinforced plastic, 6 inches square and ⅜ inches thick, using a commercially available polysulfide cement known as Coast Pro Seal 890 as the adhesive. The tiles contained 10.85 percent Carbon, approximately 63 percent titanium and 26 percent nickel, by weight. The tiles were Rockwell A 86 to 87 in hardness. The weight per square foot of this armor was 12.65 pounds.

The tiles defeated, (on an average computed and known to those skilled in the art as the Navy Protection Ballistic Limit ($V_{50}$)), caliber 0.30 AMP2 projectiles at 0° obliquity and a velocity of 3047 feet/second.

EXAMPLE II

A disc having essentially the same composition and internal structure as those in Example I but a diameter of 5¾ inches and a thickness of one-fourth inch was mounted on a 12 inches square of glass reinforced plastic backing which was ⅜ inches thick.

This target defeated a caliber 0.30 APM2 round fired at it at 0° obliquity and 2783 feet per second and retained the broken projectile shank. Although the target was fractured, the secondary fragmentation was not particularly severe, with 75 percent of the target remaining adhered to the supporting glass reinforced plastic backing.

EXAMPLE III

A 6⅛ diameter disc, ¼ inch thick, prepared as in Example I but with a composition of 8.7 percent Carbon, 60.1 percent titanium, and 31.2 percent nickel by weight was cemented to a glass reinforced plastic backing. The hardness of the disc was Rockwell A 82–84.

The disc defeated two caliber 0.30 APM2 rounds, of 2834 and 2728 feet/second respectively. Despite the proximity of the two closely spaced impacts, 2½ inches center to center, over 85 percent of the disc remained adhered to the glass reinforced backing.

Obviously numerous modifications and variations of the present invention are possible in light of the above teachings. It is therefore to be understood that, within the scope of the appended claims, the invention may be practiced otherwise than as specifically described.

What is claimed as new and desired to be secured by Letters Patent of the United States is:

1. Armor plating comprising:

tiles arranged in an array, comprising titanium carbide particles finely dispersed in a matrix of tough crack resistant titanium-nickel alloy, the titanium carbide particles constituting from 30 to 60 weight percent of the tile and the matrix of titanium-nickel alloy the remainder, the composition of the matrix being from about 44 to about 46 titanium and from about 54 to about 56 nickel by weight percent, provided that the tile has a Rockwell-A hardness of at least 82, and further provided that the tile be at least 1⅛ inches on a side when square and have a diagonal of at least 1 inch when other than square, A support layer fastened to the underside of said tiles and being composed of a material selected from the group consisting of (a) woven roving glass reinforced plastic, (b) alloys of aluminum which have a brinell hardness between 80–130, and (c) alloys of titanium which have a Rockwell C hardness of 5–40.

2. Armor plate according to claim 1 wherein the matrix of titanium-nickel alloy is composed of 50 atomic present titanium and 50 atomic percent nickel.

3. Armor plate according to claim 1 wherein said plastic is selected from the group consisting of polycarbonates, polyesters, phenolics, polyolefins, and expoxies.

* * * * *